US007140561B2

(12) United States Patent
Heren et al.

(10) Patent No.: US 7,140,561 B2
(45) Date of Patent: Nov. 28, 2006

(54) PIVOTING SPRAY WAND

(75) Inventors: Lawrence P. Heren, East Peoria, IL (US); Jincheng Xu, Zhouxiang Cixi (CN); Scott Jacobs, Peoria, IL (US)

(73) Assignee: L.R. Nelson Corporation, Peoria, IL (US)

( * ) Notice: Subject to any disclaimer, the term of this patent is extended or adjusted under 35 U.S.C. 154(b) by 162 days.

(21) Appl. No.: 10/835,691

(22) Filed: Apr. 30, 2004

(65) Prior Publication Data

US 2005/0242210 A1 Nov. 3, 2005

(51) Int. Cl.
*B05B 15/08* (2006.01)

(52) U.S. Cl. ..... 239/525; 239/392; 239/451; 239/587.5; 239/587.2

(58) Field of Classification Search .. 239/587.1–587.6, 239/392, 393, 397, 451, 525, 256, 530, 532; 285/184, 185
See application file for complete search history.

(56) References Cited

U.S. PATENT DOCUMENTS

| | | | | | |
|---|---|---|---|---|---|
| 965,709 | A | * | 7/1910 | Hart | 239/587.2 |
| 992,193 | A | * | 5/1911 | Hart | 285/127.1 |
| 1,568,442 | A | | 1/1926 | Carver | |
| 1,615,169 | A | | 1/1927 | Ellis | |
| 1,818,388 | A | * | 8/1931 | Farley | 15/104.92 |
| 1,880,826 | A | * | 10/1932 | Corley | 239/461 |
| 2,240,392 | A | * | 4/1941 | Dowell | 239/525 |
| 3,782,837 | A | | 1/1974 | Feldmann | |
| 4,032,239 | A | | 6/1977 | Maupin | |
| 4,720,883 | A | | 1/1988 | Sanchez | |
| 5,280,738 | A | | 1/1994 | Liou | |
| 5,870,932 | A | | 2/1999 | Brooke | |
| 5,884,842 | A | | 3/1999 | Caine et al. | |
| 5,889,275 | A | | 3/1999 | Chen | |
| 5,947,388 | A | | 9/1999 | Woodruff | |
| 6,216,965 | B1 | | 4/2001 | Chao | |
| 6,264,121 | B1 | | 7/2001 | McClary | |
| 6,336,764 | B1 | | 1/2002 | Liu | |
| 6,394,682 | B1 | | 5/2002 | Zhadanov et al. | |
| 6,511,001 | B1 | | 1/2003 | Huang | |
| 6,540,159 | B1 | | 4/2003 | Wang | |
| 6,540,163 | B1 | | 4/2003 | Huang | |
| 6,554,213 | B1 | | 4/2003 | Chen | |
| 6,568,610 | B1 | | 5/2003 | Ericksen | |
| 6,595,439 | B1 | | 7/2003 | Chen | |
| 2001/0000092 | A1 | | 4/2001 | Jarvis | |
| 2003/0010851 | A1 | | 1/2003 | Chen | |
| 2003/0201348 | A1 | | 10/2003 | Kao | |

* cited by examiner

*Primary Examiner*—David A. Scherbel
*Assistant Examiner*—Jason Boeckmann
(74) *Attorney, Agent, or Firm*—Brinks Hofer Gilson & Lione

(57) ABSTRACT

An adjustable spray wand is disclosed. The spray wand comprises a spray head body, a swiveling member, a locking mechanism, and a handle. The spray head body is rotatably coupled to the swiveling member. The spray head further has a locking mechanism having a contact arm having a first position allowing the swiveling member to rotate relative to the spray head body and an engagement position engaging the swiveling member and locking the swiveling member in one position. The swiveling member is coupled to a handle with a conduit, which may be coupled to a water source. In operation, water flows from the water source, through the handle, through the swiveling member, through the spray head body, and out of the outlets in a variably selected spray pattern.

17 Claims, 6 Drawing Sheets

PIVOTING SPRAY WAND

FIELD OF INVENTION

The present invention relates generally to the field of water spray devices. More specifically, the present invention is directed to an adjustable spray wand for irrigation applications.

BACKGROUND OF INVENTION

Various spray wands have been used in the past. A typical spray wand has a handle with a water passage leading to a spray head body which discharges water through a plurality of spray nozzles. The spray head body of many prior art spray wands cannot be angularly adjusted, which results in operational inflexibility. However, several prior art spray wands have included spray head bodies that may be angularly adjusted by means of flexible tubes, slide blocks, or locating pins. However, such spray wands lack a locking mechanism to fix the position of the adjustable spray head body. As a result, the user may be inconvenienced if the angle of the spray head body is altered by hitting an object or as a result of the pressure of the water passing through the spray wand.

Another problem with some prior art adjustable spray wands is that they require the use of extra pieces, such as bellows, to conduct the flow of water through the spray wand and prevent leaking. However, such extra pieces add to the bulk and manufacturing cost of the spray wand.

Another problem with some prior art spray wands is that the water passage leading to the spray head is offset from the middle of the handle and spray head body. Accordingly, such a spray wand is more difficult to handle and is less visually pleasing than a spray wand having a water passage down the middle of the handle and spray head body. Furthermore, such spray wands may experience an offset force caused by the internal water pressure in the water passage.

Thus, there is a need for an improved pivoting spray wand with an adjustable spray head with a locking mechanism. There is a further need for a spray wand with an adjustable spray head with a locking mechanism that does not require the use of extra pieces to conduct the flow of water through the spray wand to prevent leaking. There is a further need for a spray wand with an adjustable spray head with a locking mechanism that has a water passage down the middle of the handle and spray head body.

SUMMARY OF THE INVENTION

These needs and others may be met by the present invention. The present invention is embodied in a spray wand having a spray head body rotatably coupled to a swiveling member. The swiveling member is, in turn, connected to a handle which may be coupled to a water source. The spray head body may be angularly adjusted relative to the swiveling member and locked in place by a locking mechanism.

More specifically, the present invention is directed toward a spray wand allowing for the spray of water, comprising a spray head body, a swiveling member, a locking mechanism, a cylindrical plug, and a handle. The spray head body has an outlet end and an opposite top end with a pair of arms. The swiveling member has an inlet end and an opposite end with a cylindrical outer surface having a series of notches and a cylindrical cavity with an inner surface. The pair of arms further have a circular hole having the same diameter as the cylindrical cavity of the swiveling member. The cylindrical plug is enclosed in the cylindrical cavity and the circular hole, rotatably coupling the opposite end of the swiveling member between the pair of arms. The spray head further has a locking mechanism having a contact arm coupled between the pair of arms, the contact arm having a first position allowing the swiveling member to rotate relative to the pair of arms and an engagement position engaging one of the notches in the opposite end of the swiveling member and locking the swiveling member in one position. The inlet end of the swiveling member is coupled to a handle with a conduit, which may be coupled to a water source. In operation, water flows from the water source, through a conduit in the handle, into the inlet end of the swiveling member, through a conduit in the swiveling member, out of an aperture in the inner surface of the swiveling member, into the cylindrical plug, through a hollow cavity in the cylindrical plug, out of apertures in the cylindrical plug, into the spray head, and out of outlets in a circular face plate. The spray pattern of the water from the outlets of the spray head may varied by rotating the circular face plate to one of multiple predetermined positions.

It is to be understood that both the foregoing general description and the following detailed description are not limiting but are intended to provide further explanation of the invention claimed. The accompanying drawings, which are incorporated in and constitute part of this specification, are included to illustrate and provide a further understanding of the method and system of the invention. Together with the description, the drawings serve to explain the principles of the invention.

BRIEF DESCRIPTION OF DRAWINGS

These and further aspects and advantages of the invention will be discussed more in detail hereinafter with reference to the disclosure of preferred embodiments, and in particular with reference to the appended Figures wherein.

DESCRIPTION OF THE PREFERRED EMBODIMENT

Figure 1:
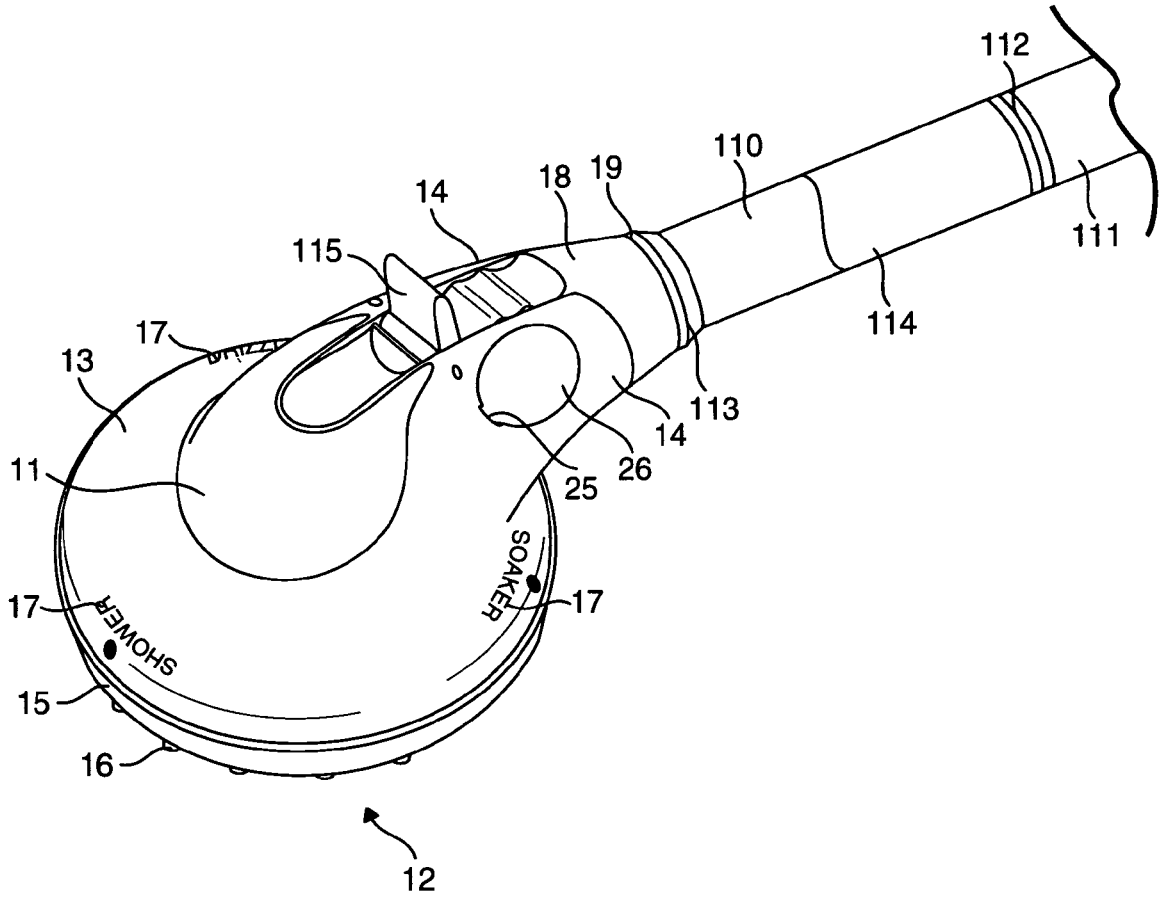
FIG. 1 is a perspective view of a spray wand according to one example of the present invention.

While the present invention is capable of embodiment in various forms, there is shown in the drawings and will hereinafter be described a presently preferred embodiment with the understanding that the present disclosure is to be considered as an exemplification of the invention, and is not intended to limit the invention to the specific embodiment illustrated.

Figure 2:
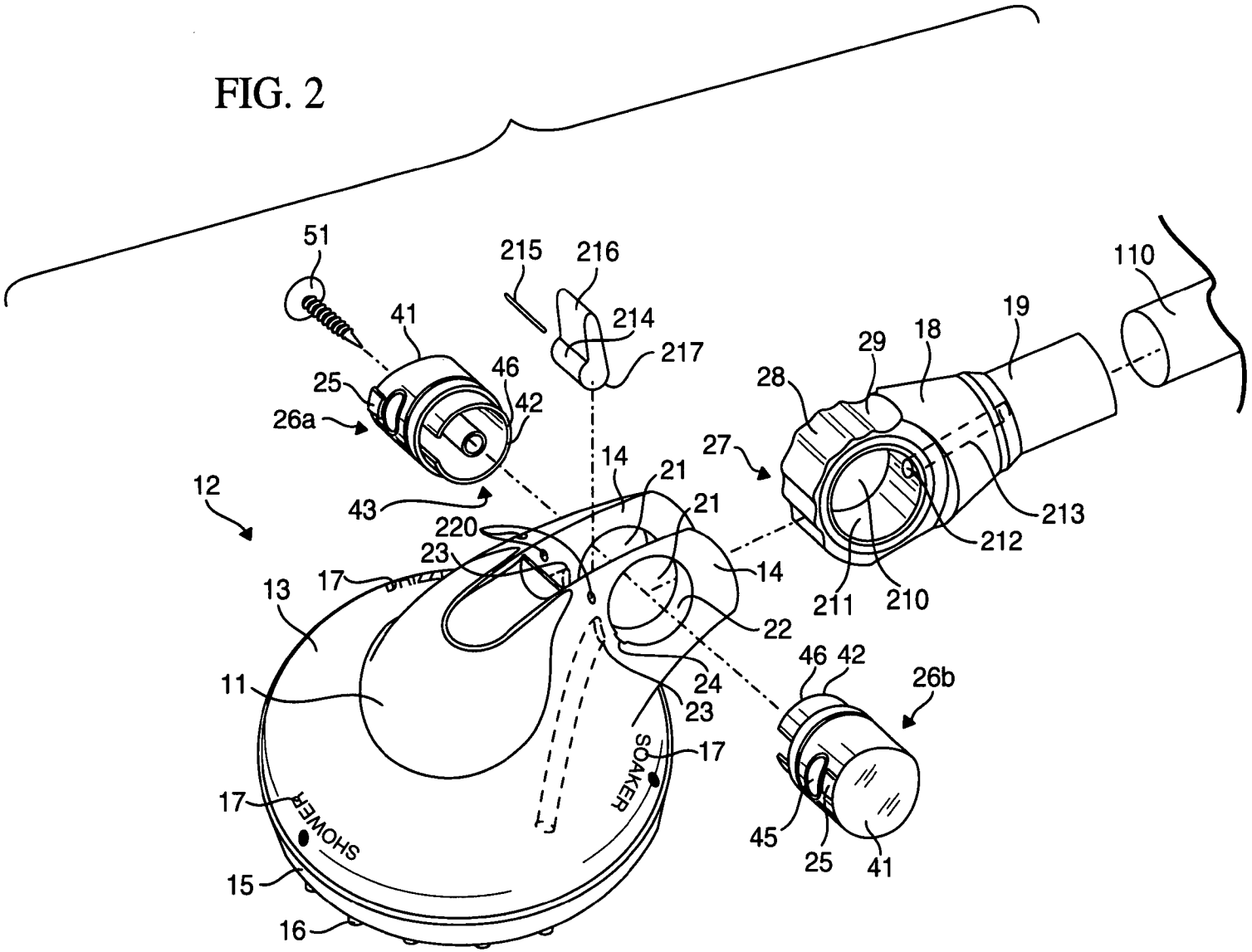
FIG. 2 is an exploded view of the components of the spray wand in FIG. 1.

Referring now to the drawings, FIGS. 1–2 show, generally, a spray wand which is one example of the present invention. The spray wand has a spray head [11] with an outlet end [12], an opposite top end [13], and a pair of arms [14] extending from the middle of the top end. The top end [13] of the spray head is generally circular in shape and has a sloping top surface below the pair of arms [14]. The top end slopes to the outlet end [12], which is coupled to circular face plate [15] having a plurality of outlets [16] for water flow from the spray wand. In the preferred embodiment, the circular face plate [15] may be rotated between three predetermined positions to emit the desired water spray pattern from the plurality of outlets [16]. This type of mechanism for producing various spray patterns is well known in the art. Numerous types of spray heads of the type well known in the art may be utilized without departing from the invention. For the circular face plate of the preferred embodiment, the predetermined positions are indicated by labels [17] on the top end [13] of the spray head. Alternatively, a non-rotatable face plate may be used which allows only a single water spray pattern. Each of the pair of arms [14] has a circular hole [21] with an inner surface [22] having an aperture [23] leading to a conduit to the outlet end [12]. The outer edge of each of the circular holes [21] also has a notch [24], capable of engaging a projection [25] on the outer ends of the circular plug [26]. The spray head body is molded from plastic, although any sturdy, waterproof material such as brass or zinc alloy may be used.

The spray wand also has a swiveling member [18], having an end with an inlet [19] connected to the outlet end of the handle [110] and an opposite end [27] from the inlet end [19], the opposite end [27] being rotatably coupled between the pair of arms [14] by the cylindrical plug [26]. In the preferred embodiment, said opposite end [27] of the swiveling member has a cylindrical outer surface [28] having a series of curved notches [29]. The cylindrical outer surface [28] forms a cylindrical cavity [210] with an inner surface [211] having an aperture [212]. A conduit [213] allows water flow between the inlet end [19] and the aperture [212]. The diameter of the cylindrical cavity [210] is the same as the diameter of the circular holes [21] of the pair of arms [14]. The swiveling member is molded from plastic, although any sturdy, waterproof material such as brass or zinc alloy may be used.

The handle [110] may be coupled to a water source [111], such as a garden hose, and has a conduit extending therethrough, allowing fluid communication from the inlet [112] (which is in fluid communication with the water source) to the outlet [113] (which is in fluid communication with the inlet end [19] of the swiveling member [18]). The handle preferably has a hand grip [114], permitting comfortable gripping of the spray wand by the user. The hand grip [114] is preferably made of a resilient and soft material such as rubber or an elastomeric polymer in order to facilitate the gripping of the handle [110]. The hand grip [114] is of sufficient size to fit within an average user's hand. The handle [110] may also have a mechanism for varying the flow of water from the spray wand. In the present invention, this mechanism is preferably a trigger hand grip [114], which permits the user to squeeze a trigger on the hand grip [114] to allow water to flow through the conduit in the handle. The handle is formed from aluminum, although any sturdy, waterproof material such as plastic, brass, or zinc alloy may be used.

Figure 4:
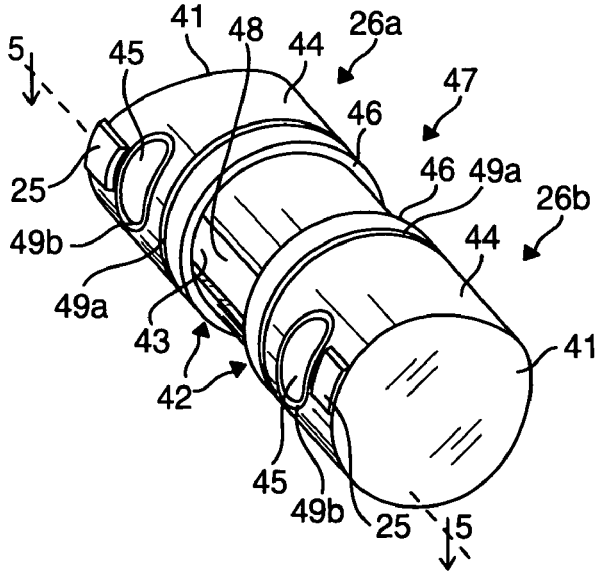
FIG. 4 is a perspective view of the cylindrical plug of the spray wand in FIG. 1.
Figure 5:
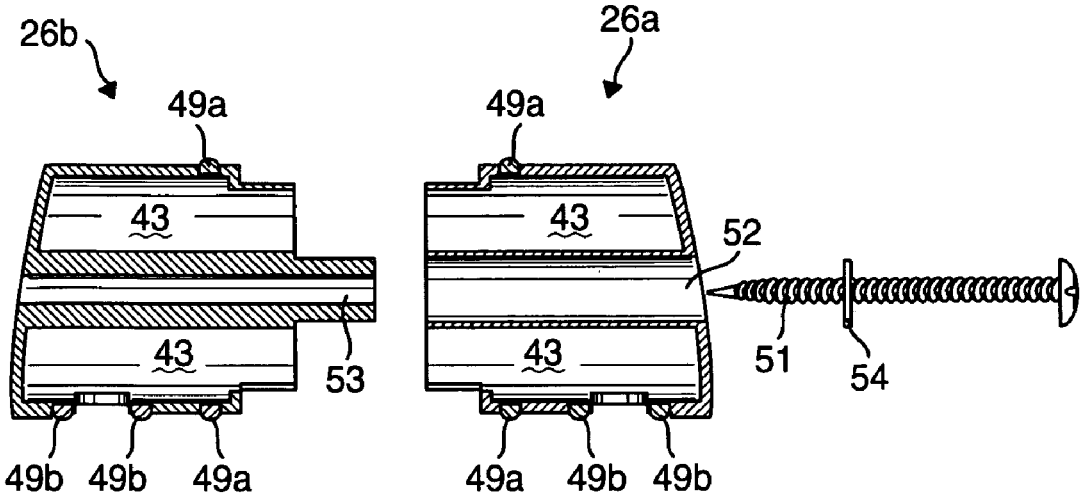
FIG. 5 is a cross section of the cylindrical plug of the spray wand of FIG. 1.

In the preferred embodiment, the spray wand also has a cylindrical plug comprised of a first half-plug [26*a*] and a second half-plug [26*b*]. As shown in FIG. 2, FIG. 4, and FIG. 5, each half-plug [26*a*, 26*b*] has an outer closed end [41], an inner open end [42], an inside cavity [43], and a side wall [44]. The side wall [44] is flush to the inner surface [211] of the cylindrical cavity [210] and the inner surface [22] the circular holes [21] with an aperture [45] aligned with an aperture [23] of the inner surface [22] of one of the circular holes [21]. The outer closed end [41] has a projection [25] capable of engaging the notches [24] of the pair of arms [14] and thereby preventing the rotation of the cylindrical plug [26] and aligning the apertures [45] with the apertures [23] of the inner surface [22] of the circular holes [21]. The inner open end [42] has a shoulder [46] forming a groove [47] around the entire circumference of the half-plugs [26*a*, 26*b*], in alignment with the aperture [212] on the inner surface [211] of the cylindrical cavity [210] of the swiveling member [18]. Each groove [47] has a hole [48] leading to the inside cavity [43] which is in fluid communication with the apertures [45]. Rubber seals [49A, 49B], which are raised slightly above the surface of cylindrical plug, allow the cylindrical plug to fit snugly inside the pair of arms [14] and prevent leakage without requiring any additional parts. Circular seals [49A] fit in a shallow groove around the circumference of the cylindrical plug, while curved rectangular seals [49B] fit in a shallow groove surrounding the apertures [45].

To connect the half-plugs, a screw [51] fits through the hollow cylinder [52] of the first half-plug [26*a*] and screws into a recess [53] in the second half-plug [26*b*], thereby coupling the two half-plugs together to form the entire cylindrical plug [26]. An o-ring or gasket is preferably placed under the screw head to prevent water leakage around the screw. Additionally, the outer closed ends [41] of the cylindrical plug [26] may be welded to the pair of arms [14], eliminating the need to include a projection [25] and also reducing potential leakage. The cylindrical plug [26], when mounted inside the pair of arms [14] of the spray head [11] and the cylindrical cavity [210] of the swiveling member [18], rotatably couples the pair of arms [14] to the swiveling member [18], which rotates freely about the cylindrical plug [26]. The cylindrical plug is molded from plastic, although any sturdy, waterproof material such as brass or zinc alloy may be used.

Figure 8:
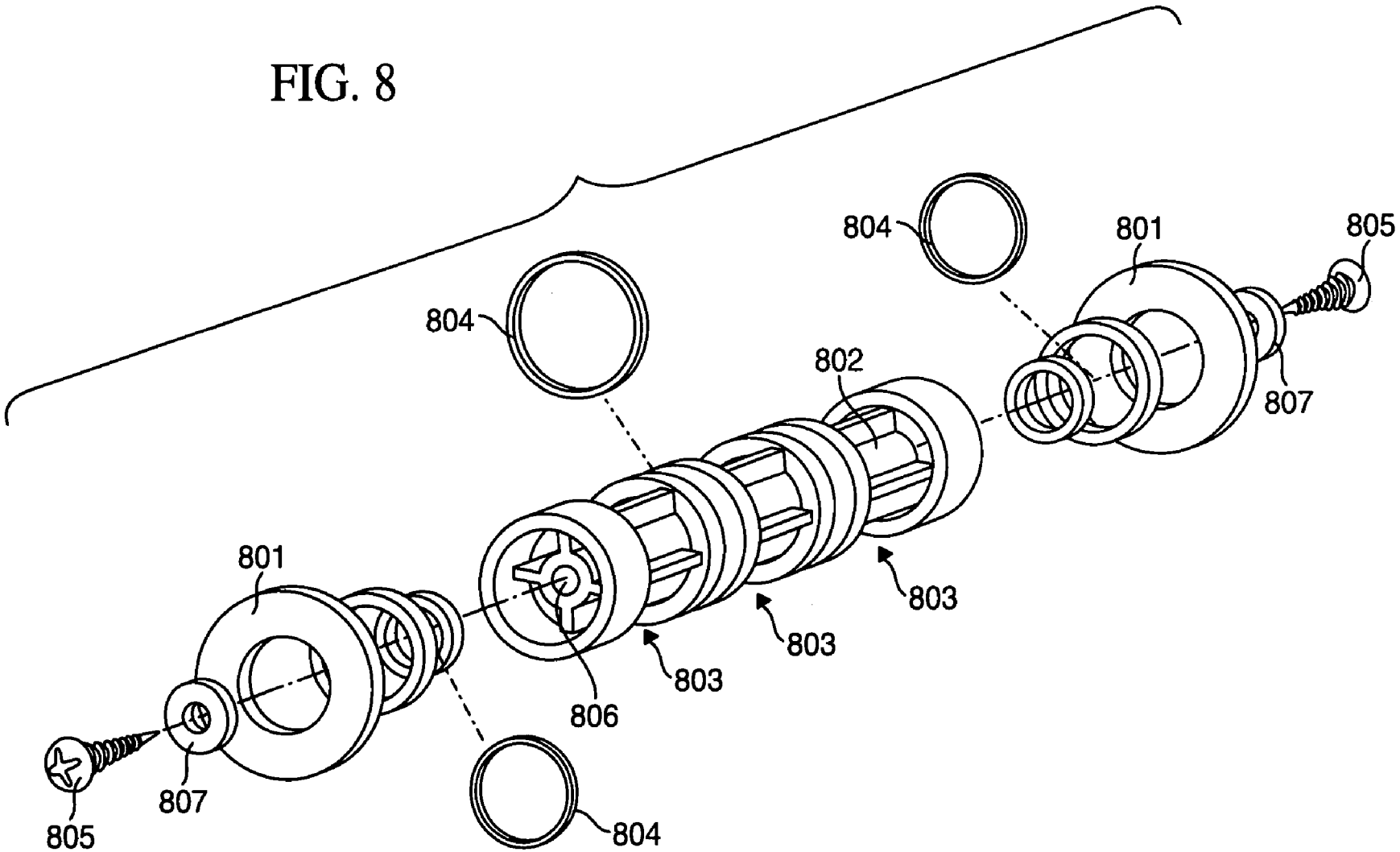
FIG. 8 is a perspective view of an alternative embodiment of the cylindrical plug of the spray wand in FIG. 1.

In an alternative embodiment of the cylindrical plug, shown in FIG. 8 in connection with FIG. 2, the cylindrical plug comprises two end caps [801] and a body [802]. The body has three apertures [803] that extend around the entire circumference of the body [802]. Each aperture [803] is in fluid communication with each of the other two apertures [803] and with one of the apertures [23] of the inner surface [22] of the circular holes [21] or the aperture [212] on the inner surface [211] of the cylindrical cavity [210] of the swiveling member [18]. Rubber o-rings [804], which are raised slightly above the surface of cylindrical plug, allow the cylindrical plug to fit snugly inside the pair of arms [14] and prevent leakage without requiring any additional parts. To connect the two end caps [801] and the body [802], a screw [805] fits through each of the end caps [801] and screws into a recess [806] in the end of the body [802], thereby coupling the two end caps and the body together to form the entire cylindrical plug [26]. An o-ring or gasket [807] is preferably placed under the screw head to prevent water leakage around the screw. Additionally, the end caps [801] of the cylindrical plug [26] may be welded to the pair of arms [14] reducing potential leakage.

Figure 3A:
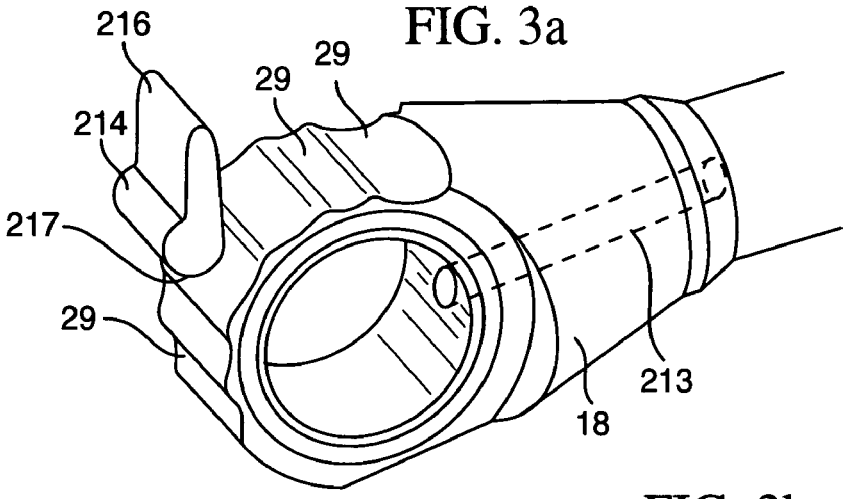
FIG. 3 is a perspective view of the swiveling member and locking mechanism of the spray wand in FIG. 1.
Figure 3B:
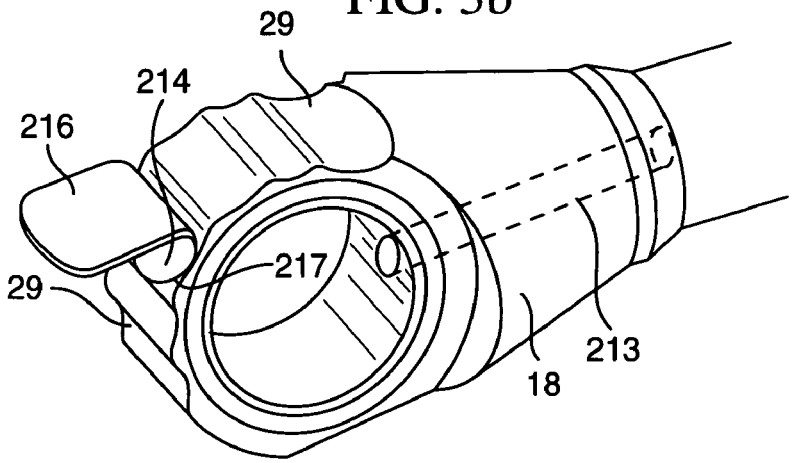
Figure 6:
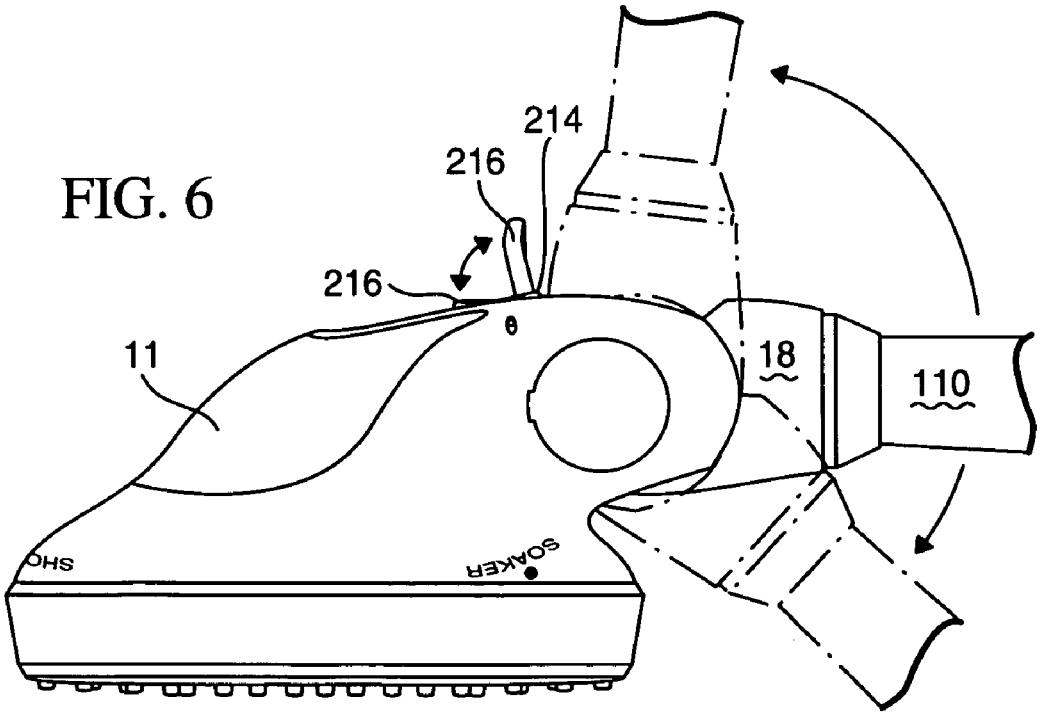
FIG. 6 is a side view of the angular adjustment and locking of the spray wand of FIG. 1.

Returning to FIG. 1 and FIG. 2, the spray wand also has a locking mechanism [115], having a contact arm [214] coupled between the pair of arms [14] by a pin [215]. The contact arm [214] rotates on the pin [215], which is preferably made of metal. The contact arm [214] has a lever [216] and a curved projection [217] capable of engaging the curved notches [29] of the swiveling member. As shown in FIG. 3, when the contact arm [214] is in a first position (labeled "Position I" in FIG. 3 and FIG. 6), with the lever [216] pointing upward, the curved projection [217] does not engage any of the curved notches [29]. When the contact arm [214] is in this first position, the swiveling member [18] may rotate relative to the pair of arms [14]. When the lever [216] is used to move the contact arm [214] to a second position (labeled "Position II" in FIG. 3 and FIG. 6), with the lever [216] substantially perpendicular to the first position, the curved projection [217] engages one of the curved notches [29], locking the swiveling member [18] in place. As shown in FIG. 6, by rotating the swiveling member [18] when the contact arm [214] is in the first position, the user may select the desired angle of the spray head [11] relative to the swiveling member [18] and the handle [110]. When the user selects the desired angle for the particular application of the spray wand, the user may move the contact arm [214] to the second position, locking the swiveling member [18] in place and ensuring that the angle of the spray head [1] relative to the handle [110] will not change during use of the spray wand. If the user desires to change the angle, he may return the contact arm [214] to the first position and select a new angle by the process described above.

Figure 7A:
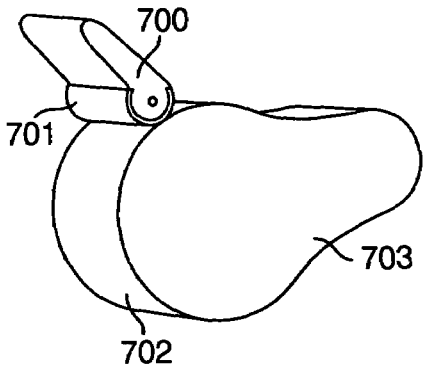
FIGS. 7A–7E are perspective views of alternative embodiments of the swiveling member and locking mechanism of the spray wand in FIG. 1.
Figure 7B:
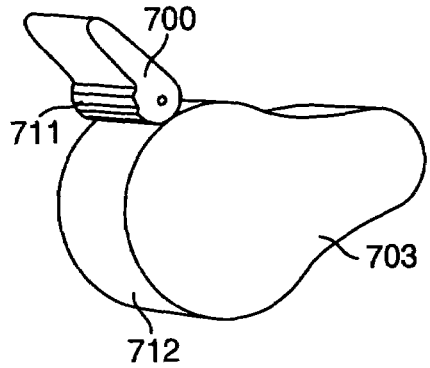
Figure 7C:
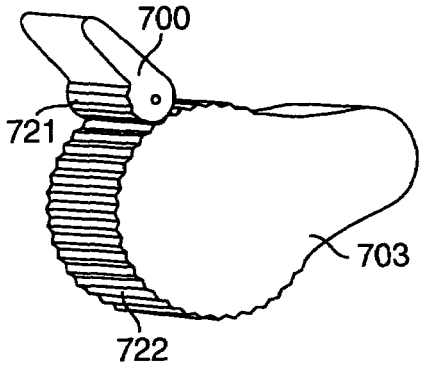

Other types of locking mechanisms can be utilized without departing from the invention. For example, other embodiments of the locking mechanism are shown in FIGS. 7A–7E. In FIG. 7A, the contact arm [700] has a smooth bonded rubber surface [701] that engages the cylindrical outer surface [702] of the swiveling member [703]. Said cylindrical outer surface [702] may be either smooth or ribbed. In FIG. 7B, the contact arm [700] has fine ribs, teeth, or knurl [711] that engages the cylindrical outer surface [712] of the swiveling member [703]. Said cylindrical surface [712] has a bonded rubber surface. In FIG. 7C, the contact arm [700] has fine teeth or ribs [721] that engage the cylindrical outer surface [722] of the swiveling member [703]. Said cylindrical surface also has fine teeth or ribs.

Figure 7D:
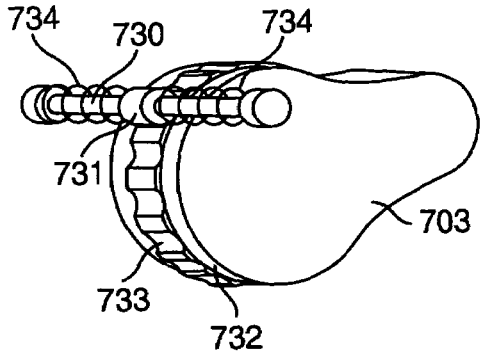

In another embodiment, in FIG. 7D, the contact arm is replaced with a push rod [730] which has a curved projection [731] that engages one of the curved notches [733] of the cylindrical outer surface [732] of the swiveling member [703]. The push rod [730], which is of a type well known in the art, must be pushed laterally such that the curved projection [731] disengages the curved notches [733], permitting the swiveling member [703] to rotate. Upon selection of a new position, springs [734] push the curved projection [731] into engagement with one of the curved notches [733].

Figure 7E:
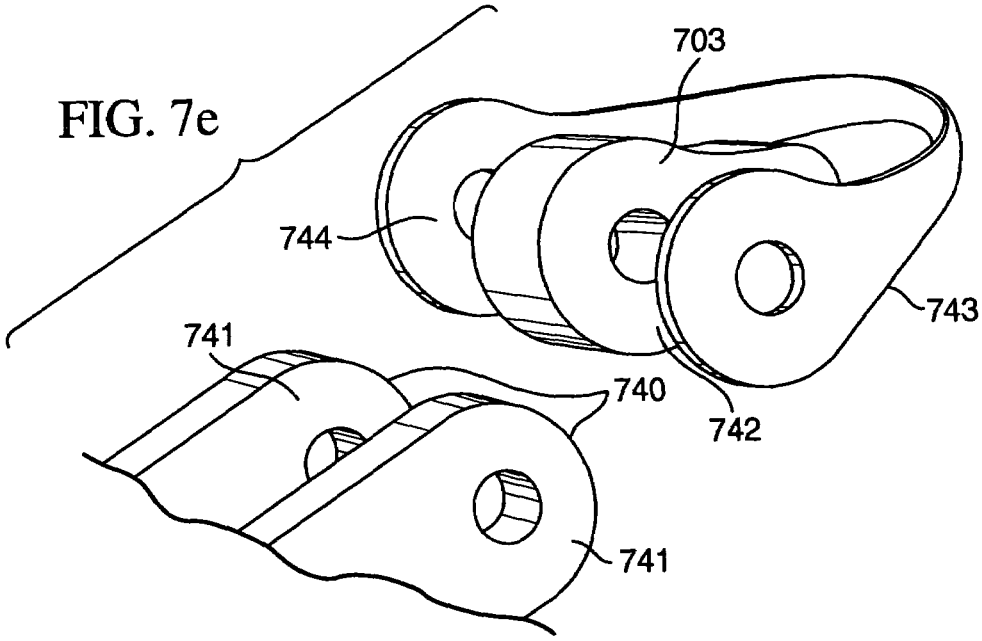

In another embodiment, shown in FIG. 7E, the pair of arms [740] extending from the spray head body have side surfaces [741] that engage (e.g. using teeth, or ribs, or a bonded rubber surface) with the side surfaces [742] of the swiveling member [703]. Fixedly coupled to the swiveling member [703] is a clamp [743]. In operation, the user may loosen the clamp [743], which permits the swiveling member [703] to rotate. However, when the user tightens the clamp [743], which also has inner side surfaces [744] that engage (e.g. using teeth, or ribs, or a bonded rubber surface) with the outer side surfaces [741] of the pair of arms [740], the clamp [743] presses together the side surfaces [741] of the pair of arms [740] and the side surfaces [742] of the swiveling member [703] and the inner side surfaces [744] of the clamp [743], resulting in the locking engagement of these parts.

Returning to FIG. 1, FIG. 2, and FIG. 4, in the operation of the preferred embodiment the user activates the trigger hand grip [114], allowing water to flow from the water source [111]: (1) through the conduit of the handle [110]; (2) into the inlet end [19], through the conduit [213], and out of the aperture [212] of the swiveling member [18]; (3) into the groove [47], through the holes [48], through the inside cavity [43], and out of the apertures [45] of the cylindrical plug [26]; (4) into the apertures [23] of the pair of arms, through the conduits of the spray head to the outlet end [12] of the spray head [11]; and (5) out of the spray wand through the outlets [16], in a pattern determined by the position of the circular face plate [15]. The spray wand is relatively simple in operation and construction allowing decreased manufacturing and assembly costs.

It will be apparent to those skilled in the art that various modifications and variations can be made in the method and system of the present invention without departing from the spirit or scope of the invention. Thus, the present invention is not limited by the foregoing descriptions but is intended to cover all modifications and variations that come within the scope of the spirit of the invention and the claims that follow.

What is claimed is:

1. A spray wand allowing for the spray of water, the spray wand comprising: a spray head body having a discharge end, an opposite top end, and a pair of arms extending from the body; a handle having an inlet adapted to be coupled to a water source, an outlet, and a conduit extending through the handle allowing fluid communication from the inlet to the outlet; a swiveling member having a conduit extending therethrough allowing fluid communication from the outlet of the handle to the spray head body, and being rotatably coupled between the pair of arms of said spray head body; and a locking mechanism having a contact arm coupled between the pair of arms, the contact arm having a first position allowing the swiveling member to rotate relative to the pair of arms and an engagement position contacting the swiveling member and locking the swiveling member in a fixed position.

2. The spray wand of claim 1 wherein the spray head body includes a face plate rotatably coupled to the discharge end, the face plate having a plurality of outlets for water flow from the discharge end.

3. The spray wand of claim 2 wherein the face plate may be rotated to a first predetermined position having a spray pattern emanating from the outlets and the face plate may be rotated to a second predetermined position having a second spray pattern emanating from the outlets.

4. The spray wand of claim 3 wherein the discharge end and the face plate are generally circular in shape.

5. The spray wand of claim 3 wherein the face plate may be rotated to a third predetermined position having a third spray pattern emanating from the outlets.

6. The spray wand of claim 2 wherein the face plate may be rotated to a plurality of predetermined positions, each of said predetermined positions creating a distinct spray pattern of water exiting from the discharge end.

7. The spray wand of claim 6 wherein the spray head body has indicia signifying the plurality of predetermined position of the face plate.

8. The spray wand of claim 1 wherein the swiveling member includes a cylindrical outer surface having a series of notches adapted to receive and engage the contact arm to hold the swiveling member in a fixed position.

9. The spray wand of claim 1 wherein the swiveling member includes a cylindrical outer surface having a series of teeth adapted to engage the contact arm to hold the swiveling member in a fixed position.

10. The spray wand of claim 1 wherein the swiveling member includes a rubber bonded cylindrical outer surface adapted to engage the contact arm to hold the swiveling member in a fixed position.

11. The spray wand of claim 1 further comprising a cylindrical plug mounted from the pair of arms; wherein said cylindrical plug includes a fluid passage therethrough; wherein the swiveling member includes an outer cylindrical surface forming a cylindrical cavity with an inner surface having a first aperture, the conduit of the swiveling member allowing fluid flow from the outlet of the handle to the first aperture, the cylindrical cavity enclosing the cylindrical plug; and wherein each of the pair of arms includes a circular hole with an inner surface, at least one of the inner surfaces of the pair of arms having a second aperture, the fluid passage of the cylindrical plug allowing fluid to flow from the first aperture to said second aperture.

12. The spray wand of claim 11 wherein said second aperture is in fluid communication with the discharge end of the spray head body.

13. The spray wand of claim 12 wherein the cylindrical plug includes a side wall flush with the inner surface of the swiveling member and closed ends flush with the arms, the side wall having a first opening in alignment with the first aperture and a second opening in alignment with the second aperture, said first opening and said second opening in fluid communication with the fluid passage of the cylindrical plug.

14. The spray wand of claim 13, wherein the cylindrical plug further comprises rubber seals around the first opening and the second opening.

15. The spray wand of claim 11, wherein said cylindrical plug is welded to the pair of arms.

16. The spray wand of claim 1, wherein the swiveling member can be rotated relative to the spray head body so as to direct the spray of water exiting the spray head body at a desired angle relative to the handle.

17. A spray wand allowing for the spray of water, the spray wand comprising: a spray head body having a discharge end, an opposite top end, and a pair of arms extending from the body; a handle having an inlet adapted to be coupled to a water source, an outlet, and a conduit extending through the handle allowing fluid communication from the inlet to the outlet; a swiveling member having a conduit extending therethrough allowing fluid communication from the outlet of the handle to the spray head body, and being rotatably coupled between the pair of arms of said spray head body; and a locking mechanism having a clamp fixedly coupled to the swiveling member, the clamp having a first position allowing the swiveling member to rotate relative to the pair of arms and an engagement position contacting the pair of arms and locking the swiveling member in a fixed position.

* * * * *